United States Patent [19]

Peterson

[11] 3,971,562

[45] July 27, 1976

[54] ROLLABLE SHEET HAVING TARGET APERTURE AND MISSILE USED THEREWITH

[76] Inventor: C. Robert Peterson, 2 E. Oak St., Chicago, Ill. 60611

[22] Filed: Aug. 5, 1974

[21] Appl. No.: 494,415

[52] U.S. Cl. ..... 273/95 R; 273/102 S; 273/102 PM

[51] Int. Cl.[2] ..... A63B 71/02

[58] Field of Search ..... 273/95 R, 102 R, 102 PM, 273/105 R, 1 R, 102 S, 26 A; 272/8 R, 8 N, 9, 11; 40/125 H, 124

[56] References Cited

UNITED STATES PATENTS

| | | | |
|---|---|---|---|
| 2,201,865 | 5/1940 | Kriekard | 273/105 R |
| 2,504,818 | 4/1950 | Findon | 273/105 R |
| 3,571,999 | 3/1971 | Downing | 40/125 H |

*Primary Examiner*—Anton O. Oechsle
*Assistant Examiner*—Marvin Siskind
*Attorney, Agent, or Firm*—Granger Cook, Jr.; Jerold A. Jacover

[57] ABSTRACT

A target game comprising a rollable sheet member having a surface and at least one edge adapted to be removably supportive from a support means is disclosed. The target game further includes indicia means on the surface of the sheet member, having target aperture means therein associated with the indicia means. The target aperture means are adapted to accommodate a target displayed in the context of the indicia means.

3 Claims, 3 Drawing Figures

ROLLABLE SHEET HAVING TARGET APERTURE AND MISSILE USED THEREWITH

BACKGROUND OF THE INVENTION

This invention relates generally to a target game and in particular to an indoor ball throwing target game suitable for children. More particularly, the target game of the invention is specifically suited for use at children's gatherings such as birthday parties and the like, though, of course, the game can be used at other times as well.

At the present time, there are a wide number of ball throwing target games in use, many of which have achieved substantial commercial success. Among these games are backstop devices which may or may not have means for catching or collecting the balls that are thrown. Other target games have resilient means, such as a spring-like web, for propelling the ball back to the thrower. Some of these ball throwing games utilize stakes or brace means for holding the target in place, and consequently, they are not practical for indoor use. Moreover, many of the target games of the prior art require bulky support structures, such as a peripheral metal frame, and as a result, they are not easily stored and are therefore most suitable for semi-permanent use.

In contrast to these ball throwing games of the prior art, the target game of the invention utilizes no stakes or brace means, and therefore, is ideally suited for indoor use. In addition, the target and surrounding material does not require a peripheral frame, making it easily stored, and less expensive than most of the target games described hereinbefore.

SUMMARY OF THE INVENTION

The target game of the invention comprises a rollable sheet member having a surface and at least one edge adapted to be removably supportive from a support means. The target game further includes indicia means on the surface of the sheet member, having target aperture means therein associated with the indicia means. The target aperture means are adapted to accommodate a target displayed in the indicia means.

Since the target game of the invention requires neither stakes nor braces, it is easily assembled and well-suited for indoor use. Moreover, after the game has been played, the sheet member can be rolled or folded to compact size, and stored away with minimal effort. The invention thus provides a novel, entertaining children's game for replacing or supplementing many of the ball throwing games presently in use.

Accordingly, it is a primary object of this invention to provide a new target game suitable for indoor use.

Another object of the invention is to provide a target game which is quickly and easily assembled.

A further object of the invention is to provide a target game which is readily disassembled, and rolled or folded into a compact size for storage.

Other objects, features and advantages of the invention will become apparent upon reading the following detailed description in conjunction with the accompanying drawings.

DETAILED DESCRIPTION OF AN EXEMPLARY EMBODIMENT OF THE INVENTION

Figure 1:
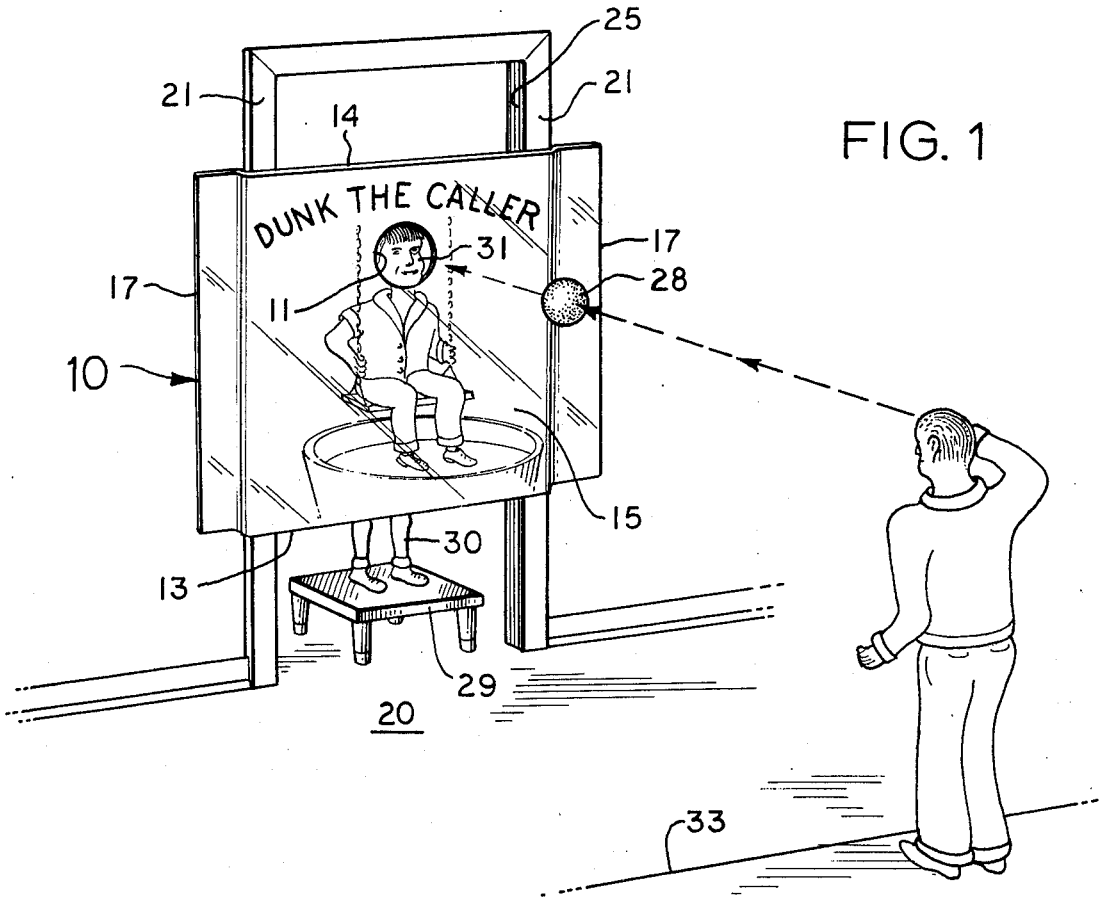
FIG. 1 is a front, perspective view of the target game of the invention.

Though the target game of the invention may take on numerous forms, in one aspect of an exemplary embodiment there is provided a non-rigid sheet member that is adapted to be removably secured to an appropriate support means. The sheet member includes indicia such as the characture of a child, with a target aperture being disposed in place of the characture's head. The characture's body may be shown seated on a swing, located above a tub of water drawn near the bottom of the sheet member. The drawing on the sheet member may, therefore, represent the popular "Dunk the Caller" game, which is familiar on amusement park midways.

It should be understood that the target game may be played according to many different game rules. For example, under one set of game rules, one of several participants is selected to serve as a target. The selected participant positions himself behind the sheet member, and puts his face in the target aperture, thus lending his countenance to the characture drawn on the sheet member. A second participant, positioned in front of the sheet member, is then given the opportunity to propel a soft missile, such as a foam rubber ball, at the face of the participant standing behind the sheet member. Thereafter, each of the other participants alternately serve as targets, and are given the chance to propel the soft missile at a fellow participant. In this manner, the familiar amusement park game of Dunk the Caller can be entertainingly, yet safely simulated in virtually any household.

Referring now to the drawings, the embodiment of the invention hereinbefore described is explained in greater detail. More particularly, in one aspect of the invention, in FIGS. 1 and 2, a frameless sheet member 10, having a bottom edge 13, a top edge 14 and a pair of opposing side edges 17 is shown. Sheet member 10 can be formed from any thin, inexpensive, yet flexibly durable material such as plastic, vinyl or cloth. The non-rigid qualities of sheet member 10 enable it to be easily reduced in size, without loss of integrity, to facilitate sale or storage. For example, sheet member 10 can be rolled up and inserted in a tubular sales/storage package, or alternatively folded into a relatively flat, compact shape.

Figure 2:
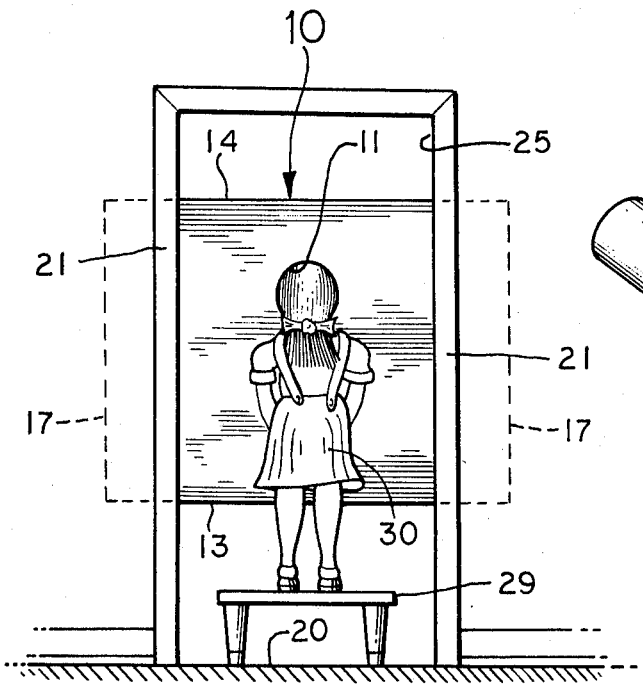
FIG. 2 is a rear view of the target game shown in FIG. 1.

Indicia are drawn on the front surface 15 of sheet member 10. For example, a characture of a child sitting on a swing is illustrated above a tub of water. Indicia, of course, may also be provided at the rear surface of sheet member 10. As shown in FIG. 1, the words Dunk the Caller may even be printed across the top of the sheet member. Thus, as described hereinbefore, the drawing on sheet member 10 simulates the familiar amusement park game of Dunk the Caller.

Disposed in sheet member 10, in place of the head of the characture drawn on sheet member 10, is a target aperture 11. Target aperture 11 is large enough to receive the face 31 of a participant such as child 30, standing behind sheet member 10. If the child is not tall enough for his face to reach target aperture 11, a stool 29, set on floor 20, can be employed.

In another aspect of the exemplary embodiment, the sheet member 10 is stretched across a passageway 25 defined by a pair of upright members 21 extending upwardly from floor 20. The sides 17 of sheet member 10 are removably secured to corresponding upright members 21 by suitable adhesive means. For example, the back of side edges 17 of the sheet member 10 may be coated with a reusable adhesive to which are applied removable protective strips. The strips are removed and the exposed adhesive side edges 17 are applied to the upright members 21. Alternatively, strips of adhesive tape 12 (or other suitable mounting means) may be used to partially overlap the sides 17 and the upright members 21, so as to display the sheet member 10 in a vertical position between the upright members 21. In general, upright members 21 form part of a conventional doorway, enabling the target game to be set up inside most any home. It should be noted, however, that any pair of upwardly extending members spaced sufficiently close together to receive respective ends 17 of sheet member 10 would suffice for the purpose of practicing the invention.

Sheet member 10 is secured across passageway 25, so that bottom edge 13 is sufficiently above floor 20 to provide an access under sheet member 10 to accommodate participants of the game. Sheet member 10 must not be secured too high on upright members 21, however, lest a child be unable to reach target aperture 11 even with the aid of a stool. When sheet member 10 is properly secured, an access is defined by floor 20, upright members 21 and bottom edge 13. This access permits a child to position himself behind sheet member 10 to put his face in target aperture 11, and then return to the front of sheet member 10 to throw a harmless missile 28 at the face of another child who has put his face in target aperture 11.

As explained hereinbefore, missile 28 is a ball fabricated from some soft, lightweight material such as foam rubber. Accordingly, even when the ball is thrown with maximum velocity, it cannot harm the child whose face is placed in target aperture 11. To insure maximum safety, however, it is recommended that, after each throw, the ball be checked to make sure a foreign object did not become lodged on its surface.

The target game of the invention can be enjoyed under a variety of circumstances, including children's gatherings such as birthday parties. At such parties, under one set of game rules, for example, one child is selected to be the target. The child then takes his place behind sheet member 10 and puts his face in target aperture 11. The other children line up facing front surface 15 of sheet member 10 behind a predetermined "foul" line such as line 33. The first child in line is then allowed a selected number of throws at target aperture 11. After the first child has completed his throws, he replaces the child who was originally behind sheet member 10, and that child goes to the end of the line.

When each child has stood behind sheet member 10 with his face in target aperture 11, and has also had a chance to throw the ball at another child, the game is over.

Figure 3:
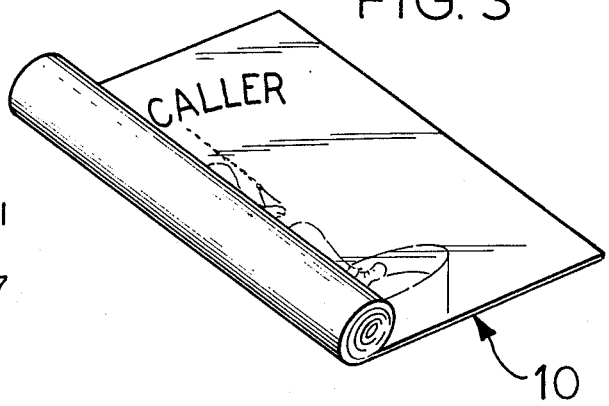
FIG. 3 represents the manner in which a frameless sheet member, comprising the target game shown in FIGS. 1 and 2, can be stored when not in use.

When the game is completed, sheet member 10 is unfastened from upright members 21 and rolled for storage as indicated by FIG. 3. The target game of the invention thus provides an entertaining economical game which can be quickly and easily set up and, when the game is finished, it can quickly be stored in a small space for later reuse.

Though the embodiment hereinbefore described is preferred, many modifications and refinements which do not part from the true scope of the invention may be conceived by those skilled in the art. It is intended that all such modifications and refinements be covered by the appended claims.

I claim:

1. A target game comprising:

a flexible sheet member having a front surface, a rear surface, a lower edge and at least one other edge adapted to be removably secured to stationary support means; said sheet member having such surface integrity as to be adapted to be rolled to form a self-supporting cylinder upon removal from said support means for insertion into a container for storage;

adhesive means, disposed on said rear surface near said other edge, for removably securing said sheet member to said support means; said adhesive means being permanently maintained on said rear surface for reuse after said sheet member is removed from, and subsequently re-secured to, said support means;

indicia means, disposed on said front surface, for representing a corporeal presence;

means defining target aperture means, communicating between said front surface and said rear surface of said sheet member; said target aperture means being associated with said indicia means for accommodating a target to be displayed within the context of said indicia means; and access means, defined by said lower edge of said sheet member, for permitting participants of the game to pass under said sheet member from a position facing said front surface to a position facing said rear surface, whereby each of said participants can individually put their face into said target aperture means to lend a personal quality to said corporeal presence.

2. The target game set forth in claim 1 further including missile means adapted to be propelled at said target in said aperture means.

3. The target game set forth in claim 2 wherein said missile means is a ball.

* * * * *